US006929196B2

(12) United States Patent
Togashi et al.

(10) Patent No.: US 6,929,196 B2
(45) Date of Patent: Aug. 16, 2005

(54) FUEL INJECTION VALVE AND INTERNAL COMBUSTION ENGINE MOUNTING THE SAME

(75) Inventors: Shigenori Togashi, Abiko (JP); Yoshio Okamoto, Minori (JP); Makoto Yamakado, Tsuchiura (JP); Masahiro Souma, Hitachi (JP); Hiromasa Kubo, Yokohama (JP)

(73) Assignees: Hitachi, Ltd., Tokyo (JP); Hitachi Car Engineering Co., Ltd., Hitachinaka (JP)

( * ) Notice: Subject to any disclaimer, the term of this patent is extended or adjusted under 35 U.S.C. 154(b) by 0 days.

(21) Appl. No.: 10/621,343

(22) Filed: Jul. 18, 2003

(65) Prior Publication Data

US 2004/0060538 A1 Apr. 1, 2004

(30) Foreign Application Priority Data

Sep. 6, 2002 (JP) ..... 2002-260752

(51) Int. Cl.[7] ..... B05B 1/30; B05B 1/34; B05B 1/00; F02M 61/00; F02M 51/00

(52) U.S. Cl. ..... 239/533.14; 239/533.12; 239/585.1; 239/585.2; 239/585.3; 239/585.4; 239/585.5; 239/596

(58) Field of Search ..... 239/533.12, 533.14, 239/585.1, 585.3, 585.4, 596

(56) References Cited

U.S. PATENT DOCUMENTS 5,076,499 A * 12/1991 Cranford ..... 239/585.2
5,211,341 A * 5/1993 Wieczorek ..... 239/585.3
6,382,533 B1 * 5/2002 Mueller et al. ..... 239/585.1
6,494,388 B1 * 12/2002 Mueller et al. ..... 239/533.12
6,766,969 B2 * 7/2004 Haltiner et al. ..... 239/596

FOREIGN PATENT DOCUMENTS

JP 10-43640 2/1998

* cited by examiner

*Primary Examiner*—David A. Scherbel
*Assistant Examiner*—Darren Gorman
(74) *Attorney, Agent, or Firm*—Antonelli, Terry, Stout & Kraus, LLP

(57) ABSTRACT

For each of the injection holes on the face of a plate member which is disposed in a fuel passage, grooves are provided which run along the circumferential direction of the respective injection holes, and at the positions of the grooves, fuel overflows are formed. As a result, contracted fuel flow portions are formed in the injection holes, so that the maximum flow velocity of fuel is increased at the injection hole outlet portions. Thus, a fuel injection valve for an internal combustion engine is provided, in which the atomization performance near the injection holes is effectively enhanced.

9 Claims, 8 Drawing Sheets

FUEL INJECTION VALVE AND INTERNAL COMBUSTION ENGINE MOUNTING THE SAME

BACKGROUND OF THE INVENTION

The present invention relates to a fuel injection valve which injects fuel into an internal combustion engine; and, more particularly, the invention relates to a technique for forming a fuel spray that has excellent atomization.

JP-A-10-43640 (1998), in particular page 2 and FIGS. 1 and 2 thereof, discloses one example of a conventional fuel injection valve, in which a valve body is provided with a valve seat at an inner wall face forming a fluid passage, a valve member for opening and closing the fluid passage by displacing a contacting portion thereof away from the valve seat and biasing the contact portion thereof into contact with the valve seat, respectively, and an orifice plate attached to the valve body at the fluid downstream side from the valve member and having an orifice penetrating the orifice plate in its thickness direction. The face of the orifice plate which faces the valve member, the end face of the valve member and the inner wall of the valve body form a substantially disk shaped fluid chamber in which an obstacle is provided for disturbing the fluid flowing from an opening, that is formed between the contacting portion and the valve seat, to the orifice.

The above-referenced patent document discloses as the obstacle for disturbing the fluid flow, the provision of an unevenness which is provided either on the end face of the valve member at the fluid flow downstream side from the opening portion between the contacting portion and the valve seat, or on the face of the orifice plate opposing the valve member.

In the above-described device, before the fuel reaches to the injection hole, a disturbance is caused in the fuel flow to make the particle diameter of the spray become small. However, in order to reduce fuel consumption effectively, or to reduce the exhaust amount of unburned gas components (HC,CO) of the fuel, further atomization of the spray is required.

SUMMARY OF THE INVENTION

An object of the present invention is to provide a fuel injection valve, which provides an improvement in atomization performance, and to provide an internal combustion engine which realizes reduction in the fuel consumption amount and reduction in the exhaust amount of unburned gas components (HC,CO) of the fuel with use of the atomization improved fuel spray.

In order to achieve the foregoing object, the present invention adopts a configuration in which a variety of grooves are provided, including an annular groove surrounding an injection hole, whereby, through a flow contracting effect on the fuel flow which overflows the groove in the injection hole, the velocity of the injection flow is increased and the atomization performance is enhanced.

DETAILED DESCRIPTION OF THE EMBODIMENTS

Various preferred embodiments of the present invention will be explained with reference to FIG. 1 through FIG. 14. In the following explanation, a plane, which includes an axial line of a valve body and which is disposed in parallel therewith, is called a vertical cross sectional plane.

Figure 1:
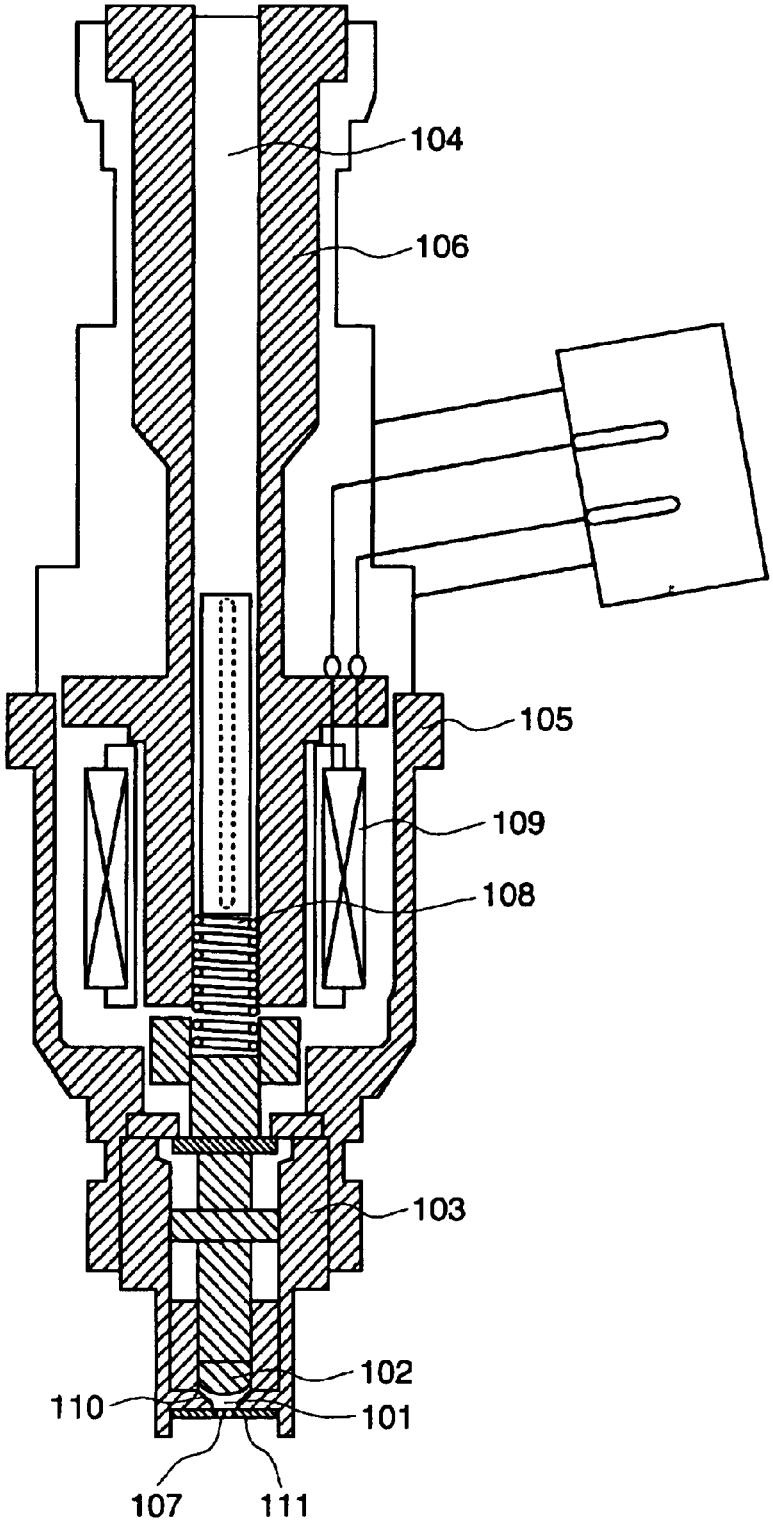
FIG. 1 is a vertical cross sectional view of a fuel injection valve representing an embodiment of the present invention.

FIG. 1 is a vertical cross sectional view showing the structure of a normally closed solenoid type fuel injection valve, which is one of the known fuel injection valve types, representing an embodiment of the present invention. However, it should be understood that the advantages of the present invention are not limited to application of the invention to a solenoid type fuel injection valve.

The fuel injection valve, as shown in FIG. 1, is provided with a yoke 105, formed of a magnetic substance, surrounding a solenoid coil 109; a core 106, which is located at the center of the solenoid coil 109 and one part of which is in contact with the core 106; a valve body 102, which is lifted by a predetermined amount when the solenoid coil 109 is excited; a valve assembly 103 having a seat face 110 facing the valve body 102; a fuel injection chamber 101, from which fuel that flows through a gap between the valve body 102 and the seat face 110 is injected, and a plate member 111 having a plurality of injection holes 107 and which is disposed under the fuel injection chamber 101.

At the center of the core 106, a spring 108 is provided as an elastic member which works to press the valve body 102 onto the seat face 110. When no current is fed to the coil 109, the valve body 102 is in close contact with the seat face 110. Fuel is supplied from a fuel supply port under a pressurized state by a fuel pump (not shown). A fuel passage in the fuel injection valve extends up to the closely contacted position of the seat face 110 with the valve body 102. When a current is supplied to the coil 109 and the valve body 102 is displaced due to the magnetic force induced thereby so that the valve body 102 separates from the seat face 110, the fuel is concentrated around the axial center in the fuel injection chamber 101; and, thereafter, the fuel flows along the plate member 111 radially in the outer circumferential direction and is injected through the plurality of fuel injection holes 107 toward an intake port of the engine, for example.

Figure 2:
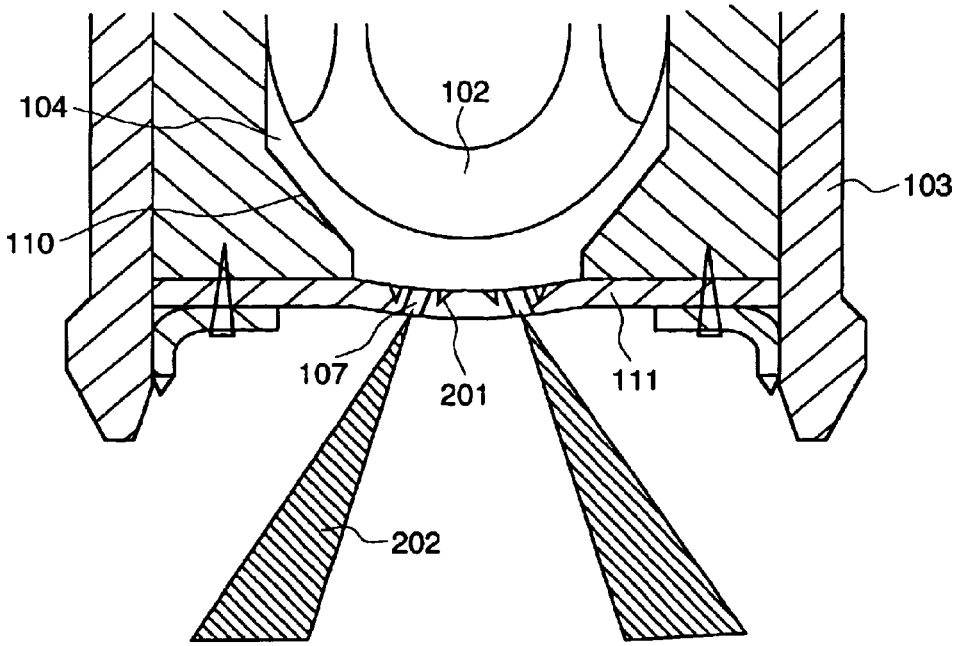
FIG. 2 is a vertical cross sectional view of a nozzle portion in an embodiment of a fuel injection valve according to the present invention.
Figure 3:
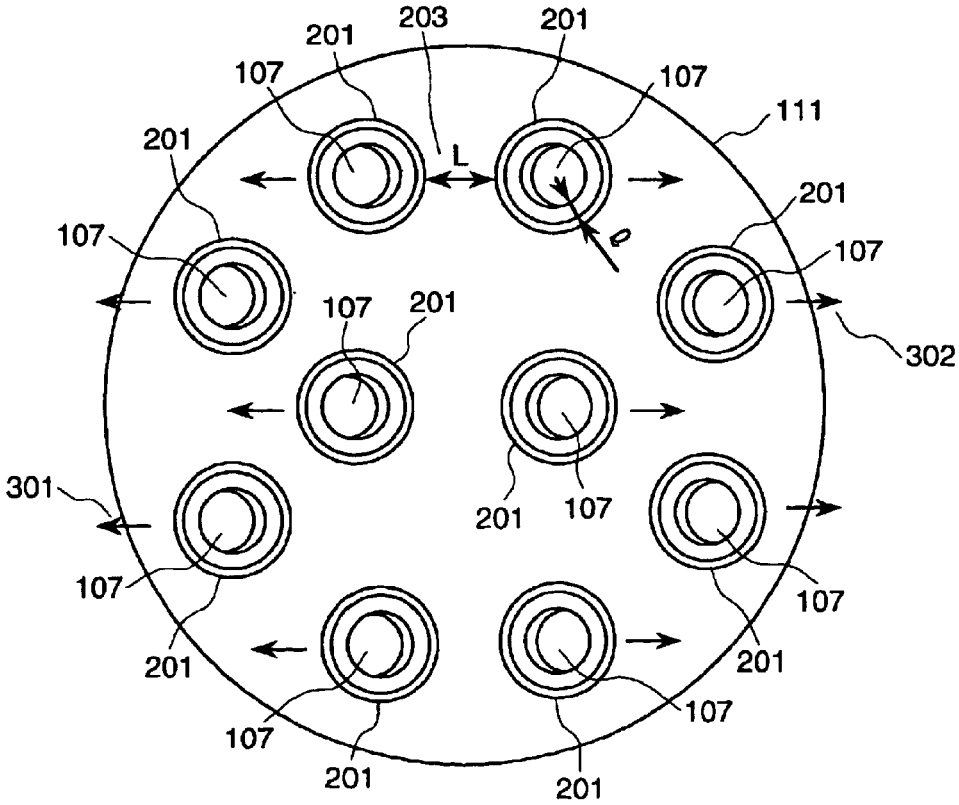
FIG. 3 is a plane view of a plate member as seen from an injection hole inlet side in the embodiment of the fuel injection valve according to the present invention.
Figure 4:
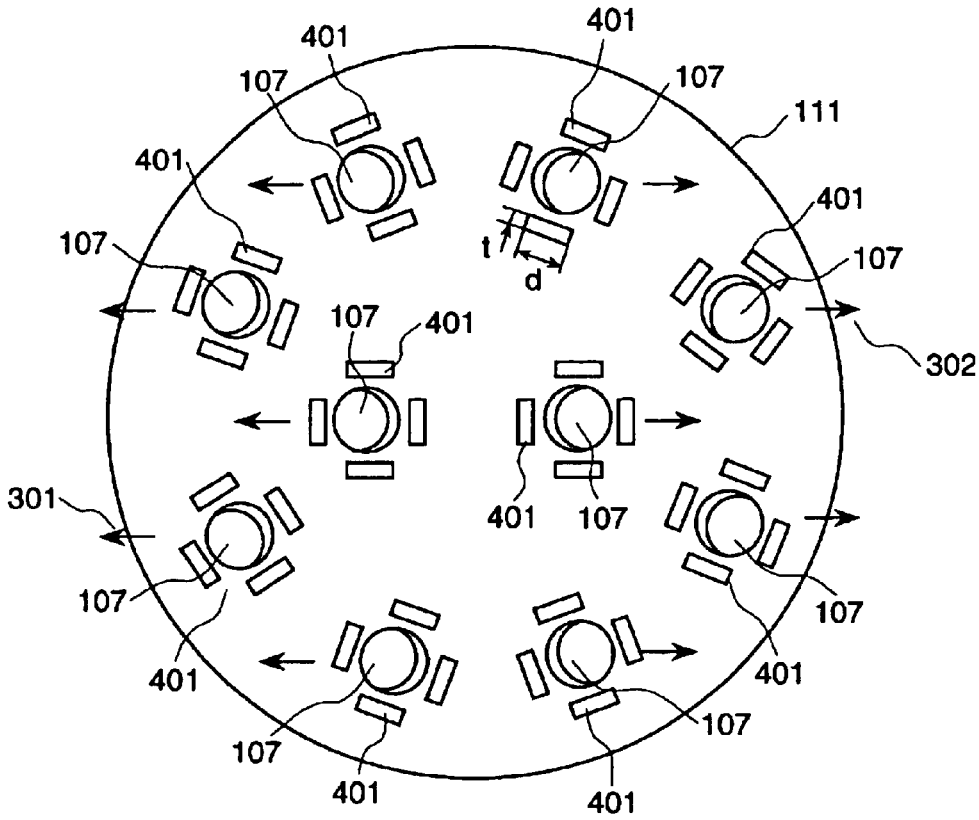
FIG. 4 is a plane view of a plate member as seen from an injection valve inlet hole in a modified embodiment of the fuel injection valve according to the present invention.

FIG. 2 is a vertical cross sectional view of the nozzle portion. A feature of the present invention is that grooves 201 are formed in the vicinity of the respective injection holes 107 on the face of the plate member 111 in the fuel injection passage, and they extend along the circumferential direction of the respective injection holes 107, as shown in FIG. 3. Since the grooves are provided so as to surround the respective injection holes 107, the respective grooves are naturally formed near the respective injection holes 107. Further, grooves other than the annular grooves 201, as shown in FIG. 3, can be used. For example, FIG. 4 shows a modification in which, instead of continuous annular grooves, four rectangular shaped grooves 401 are provided around the circumference of each of the respective injection holes. Each of the grooves 401 is configured in such a manner that, when the length of the rectangular groove 401 in the circumferential direction of the injection hole is d and the length thereof in radial direction of the injection hole is t, the ratio d/t is selected to be more than 1, so that d>t. The reason for this is that, in order to induce an overflow effect due to the presence of the grooves more efficiently, it is preferable that the circumferential length d is longer than the radial direction length t. Therefore, the most preferable configuration is the use of circumferential grooves. Further, in the FIG. 4 modification, although four rectangular grooves 401 are provided for each of the injection holes, the number thereof is not limited to four, and may be set in consideration of the allowable physical space therein.

Still further, as shown in FIG. 3, a flat portion (plane portion) 203 is formed between adjacent injection holes 107 outside of the grooves 201. The distance (interval) L between the adjacent injection holes 107 outside the grooves 201 on the flat portion 203 is determined to be longer than the distance (interval) l between the inner edge of the groove 201 and the outer edge of the injection hole 107. In other words, the groove 201 is disposed close to the injection hole 107 in such a manner that the distance l is shorter than the distance L. Further, the flat portion (plane portion) 203 contributes to an enhancing of the overflow inducing effect, which will be explained later.

Figure 5:
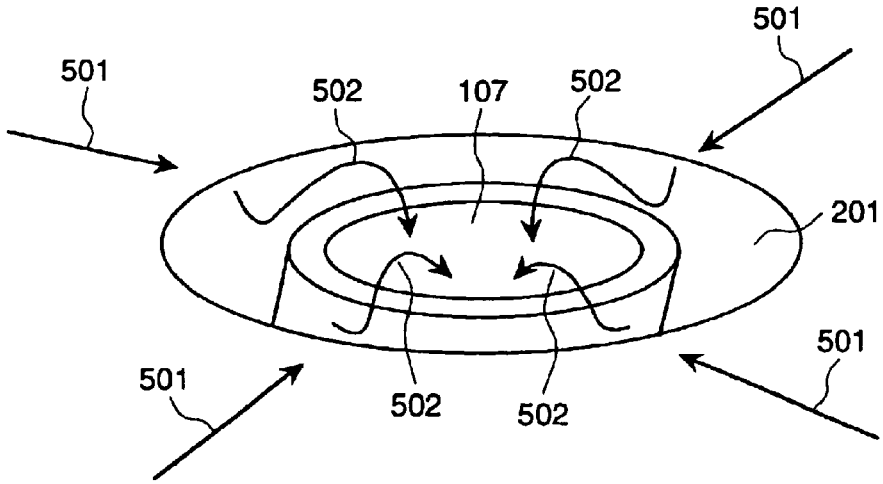
FIG. 5 is a diagram illustrating the manner in which overflow occurs around an annular groove provided near the injection hole inlet portion in the embodiment of the fuel injection valve according to the present invention.
Figure 6:
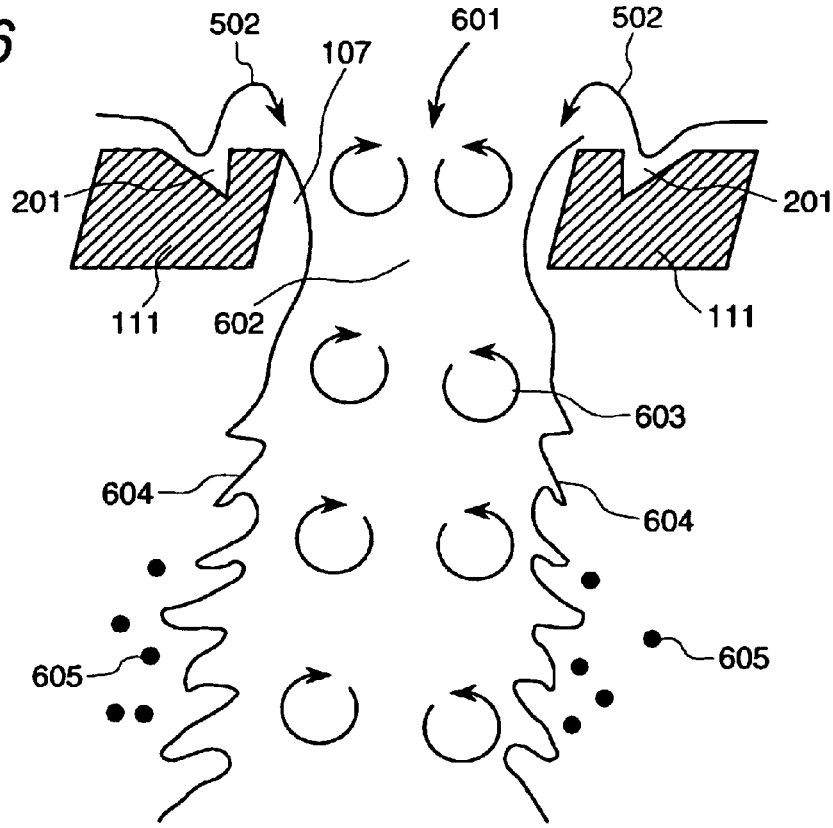
FIG. 6 is a diagram illustrating the manner in which velocity acceleration occurs due to the overflow and atomization promotion due to an eddy current in accordance with the present invention.
Figure 7:
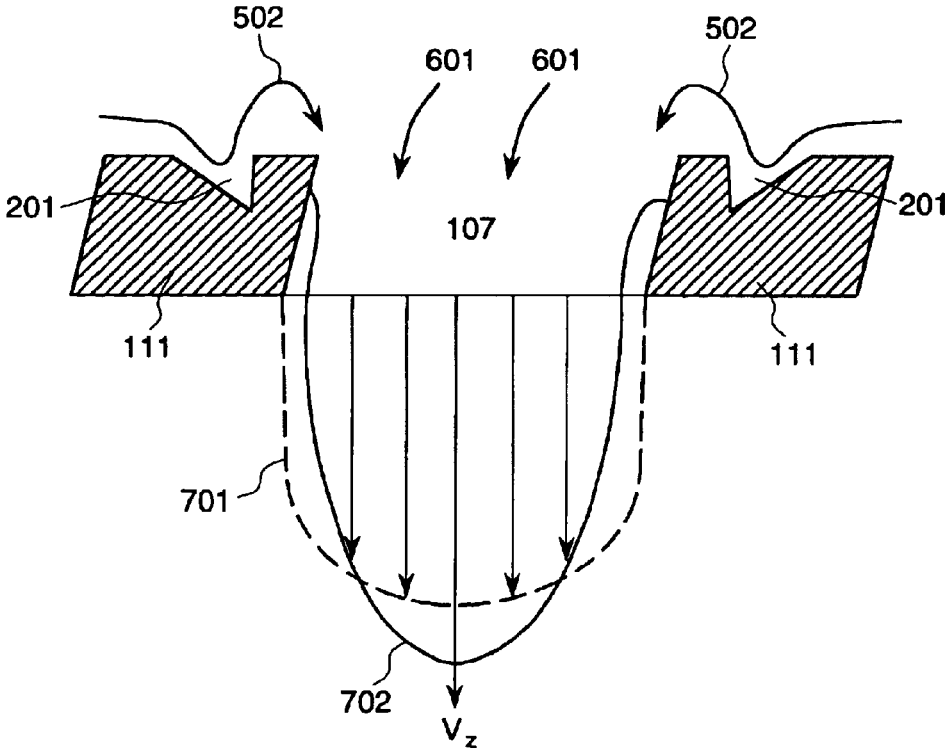
FIG. 7 is a diagram illustrating flow velocity distribution at the injection hole outlet portion in the embodiment of the fuel injection valve according to the present invention.

The function and advantages of the present invention will be explained with reference to FIGS. 5 through 7. Because of the shaping of the grooves, as described above, fuel 501, which comes from the outer circumferential direction, flows deep into the groove, forms overflows 502 and flows into the respective injection holes 107, as shown in FIG. 5. Thereafter, as shown in FIG. 6, because of the effect of the fuel flows forming the overflows 502, fuel flow 601 takes the form of a contracted flow portion 602 having a diameter which is slightly smaller than that of the injection hole 107 as the fuel is injected from the injection hole 107. FIG. 7 shows a flow velocity distribution at the injection hole outlet portion. As will be seen from FIG. 7, with the provision of the grooves 201, since the overflow 502 and the contracted flow portion 602 are formed, the maximum flow velocity in the flow velocity distribution 702 at the injection hole outlet portion is increased in comparison with that in a flow velocity distribution 701 in the case of no provision of the grooves 201. Because of this acceleration effect, the turbulence of the gas and the liquid interface between the fuel and the air is enhanced, and a large number of vortexes 603 are formed, which reduces the diameter of the spray particles 605.

Figure 8A:
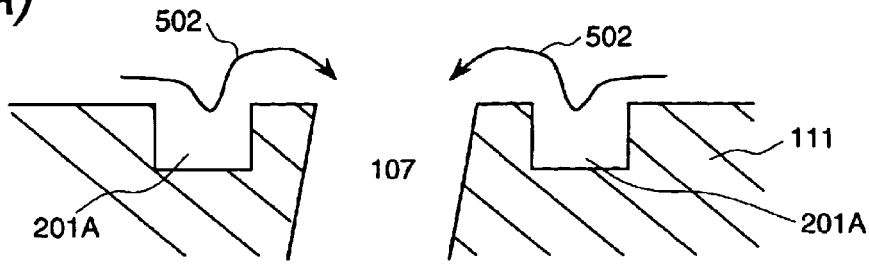
FIGS. 8(A) through 8(D) are diagrams of a variety of groove configurations for use in the embodiments of the fuel injection valve according to the present invention.
Figure 8B:
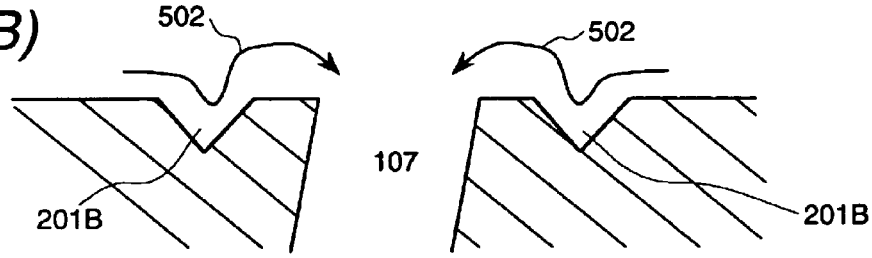
Figure 8C:
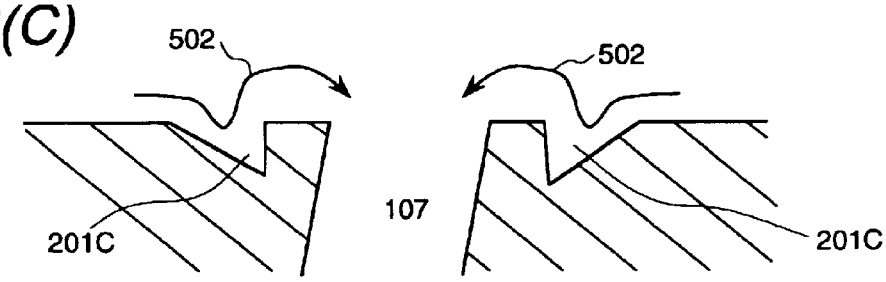
Figure 8D:
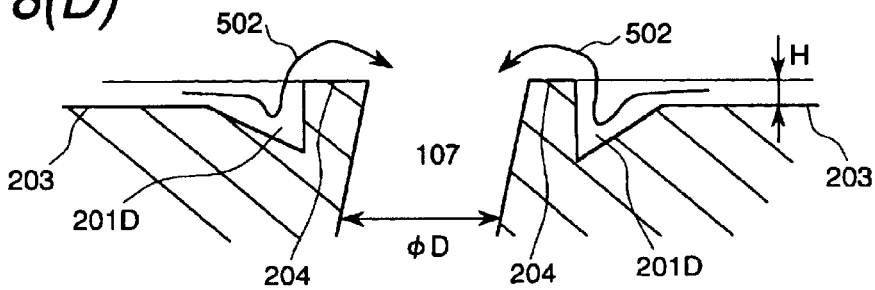

FIGS. 8(A) through 8(D) show different cross-sectional configurations of the grooves 201 that are formed around an injection hole 107. FIG. 8(A) shows an example wherein a rectangular groove 201A is formed; FIG. 8B shows another instance wherein a V shaped groove 201B is formed; FIG. 8(C) shows still another instance wherein a groove 201C is formed so that the inner side wall inclination angle near the injection hole is designed to be steeper than that remote from the injection hole; and FIG. 8(D) shows a further instance wherein a groove 201D is formed in which the top level of a projection 204 around the injection hole 107 is formed to be higher by a height H than that of the surface of the plate member 203 at the upstream side of the groove. The groove configurations as shown in FIGS. (8A) through 8(D) can basically form the overflows 502. Further, with regard to the grooves as shown in FIGS. 8(B) and 8(C), the bottom shape need not be an acute angle, but can be rounded. Still further, with regard to the groove as shown in FIG. 8(D), the height H is preferably smaller than the diameter $\phi$D of the injection hole 107, so as to form the overflows.

As has been explained above, with the fuel injection valve of the present embodiment, the overflows 502 are formed at a position where the grooves 201 are disposed; and, further, through the formation of the contracted flows 602 in the fuel injection holes 107, the maximum flow velocity at the fuel injection outlet portion is increased, whereby the turbulence of the gas and the liquid interface between the fuel and the air is enhanced, and the atomization performance is improved.

Figure 9:
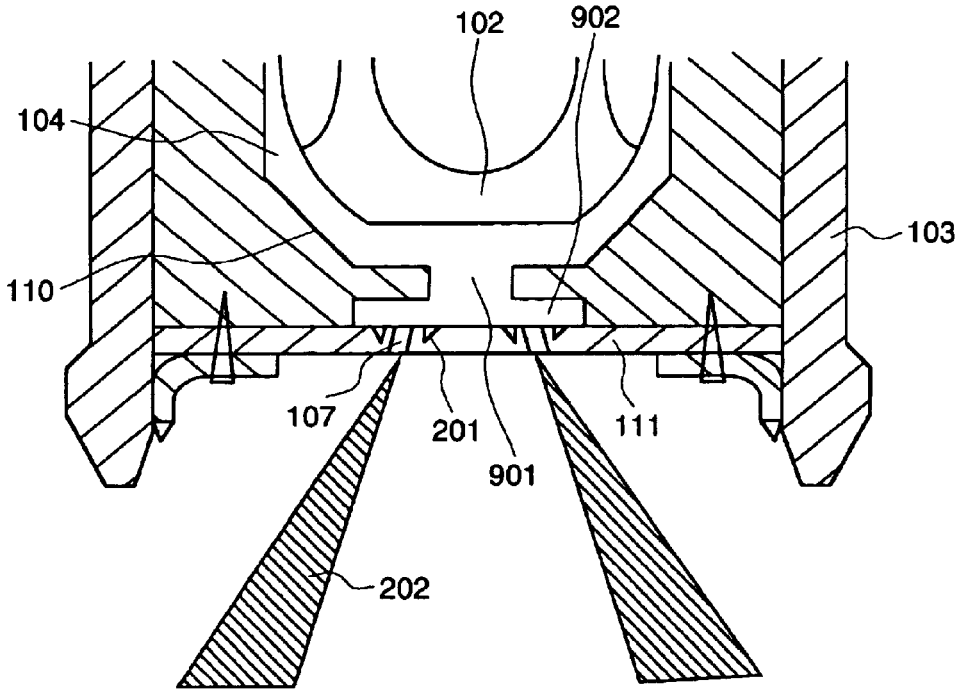
FIG. 9 is a vertical cross sectional view of a nozzle portion of an embodiment of a fuel injection valve, in which the upstream side of the plate member is structured into a radial flow type, according to the present invention.
Figure 10:
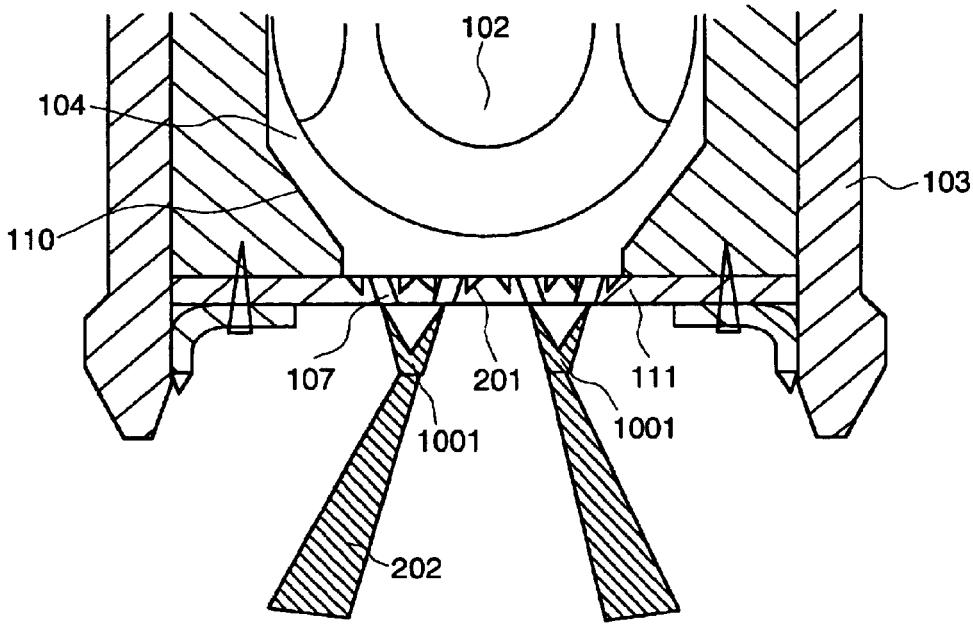
FIG. 10 is a vertical cross sectional view of a nozzle portion of an embodiment of a fuel injection valve, in which the upstream side of the plate member is structured into a collision flow type, according to the present invention.
Figure 11:
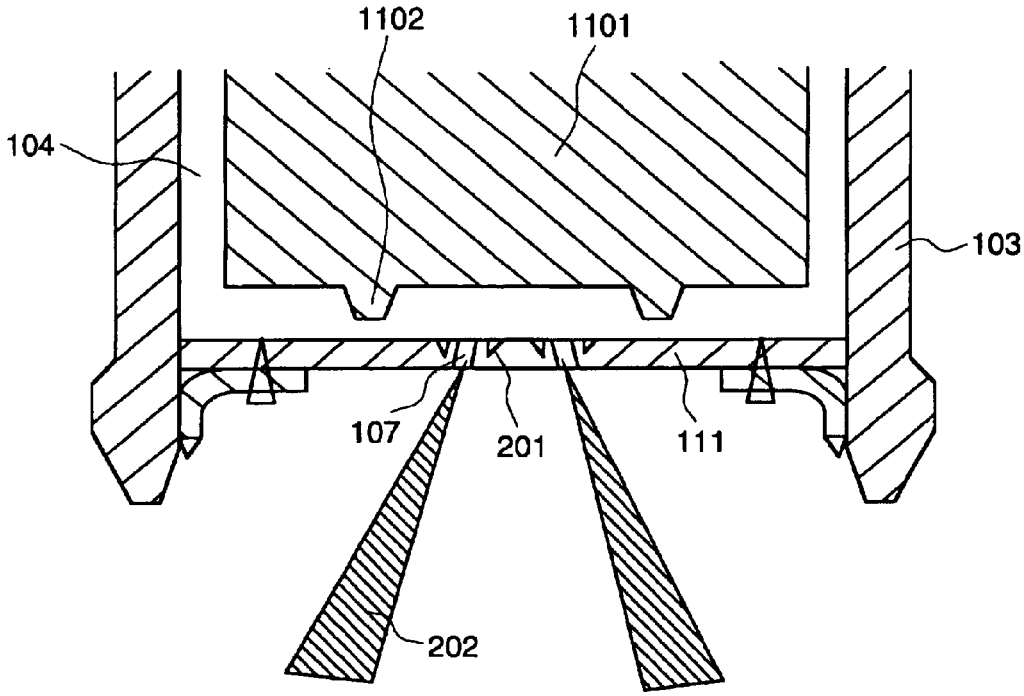
FIG. 11 is a vertical cross sectional view of a nozzle portion of an embodiment of a fuel injection valve, in which the upstream side of the plate member is structured into a flat valve type, according to the present invention.

FIGS. 9 through 11 show vertical cross sectional views of nozzle portions of respective embodiments wherein the structures upstream of the plate member 111 of the fuel injection valve according to the present invention are formed respectively in a radial flow type, a collision flow type and a flat valve type.

In the radial flow type of the fuel injection valve, as shown in FIG. 9, there is a fuel contraction portion 901, which contracts the fuel flowing through the gap between the valve body 102 and the seat face 110. Under the fuel contraction portion 901, there is a fuel outwardly radiating chamber 902, which forces the fuel to flow toward the outer circumference; and, further, under the fuel outwardly radiating chamber 902, a plate member 111 having a plurality of injection holes is provided.

In the collision flow type of fuel injection valve, as shown in FIG. 10, the fuel flows which are injected outwardly through the respective injection holes 107 on the plate member 111 collide with each other at a collision point 1001 so as to divide the spraying direction into two directions.

In the flat valve type of fuel injection valve, as shown in FIG. 11, instead of the ball valve type, as shown in FIGS. 2 and 10, the valve body 1101 is formed as a flat type; and, further, an annular seat face 1102, through which fuel supply is controlled by the vertical movement of the valve body 1101, is disposed between the valve body 1101 and the plate member 111.

Any of the above-described fuel injection valves of the radiation flow type, collision flow type and flat valve type can achieve the same or an even further atomization performance in comparison with the fuel injection valve shown in FIG. 2.

Figure 12:
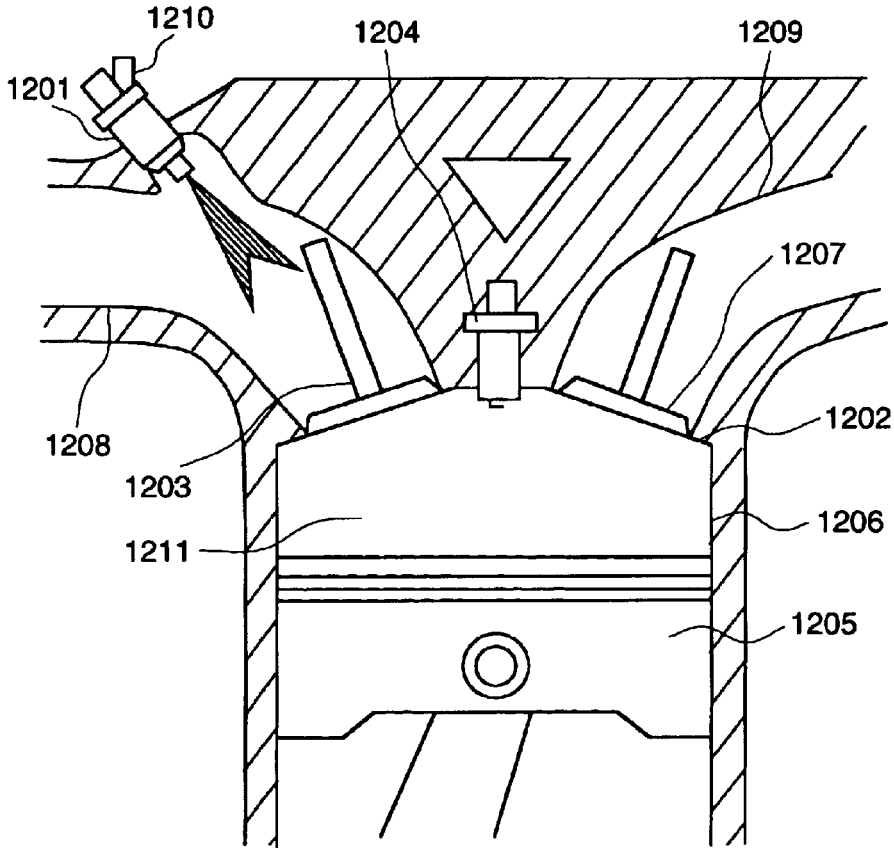
FIG. 12 is a partial cross sectional view of an embodiment in which a fuel injection valve of the present invention is mounted on an internal combustion engine.

FIG. 12 shows an example in which the fuel injection valve 1201 according to the present invention is mounted on an internal combustion engine. Since the fuel injection valve corresponds to a like solenoid type fuel injection valve as described with reference to the foregoing embodiments, a repeated explanation of the constitutional elements thereof is omitted. The internal combustion engine as shown in FIG. 12 is constituted by a cylinder head 1202, an intake valve 1203, an ignition plug 1204 which ignites the mixture gas of fuel and air, a piston 1205, a cylinder 1206, an exhaust valve 1207, an intake port 1208 which introduces air in to the cylinder 1206, and an exhaust port 1209 which exhausts the combustion gas from the cylinder. Further, the fuel injection valve is provided with a connector through which an electrical current for driving the injection valve is supplied.

Further, in FIG. 12, the intake valve 1203 is shown in a closed state. However, actually, when the fuel is injected in a spray from the fuel injection valve 1201 to the combustion chamber 1211, the intake valve 1203 is opened. Herein, the fuel injection start timing of the fuel injection valve 1201 may be either when the intake valve is actually opened or before the intake valve 1203 actually starts valve opening in view of the fuel flying time. In such instance, the fuel flying time is set in such a manner that the fuel injected at the injection start reaches the intake valve at the time when the intake valve 1203 is actually opened. Further, within an allowable range, the fuel injection start timing can be set so that the fuel injected at the injection start reaches the intake valve 1203 at the timing before the intake valve 1203 starts actual valve opening.

Figure 13:
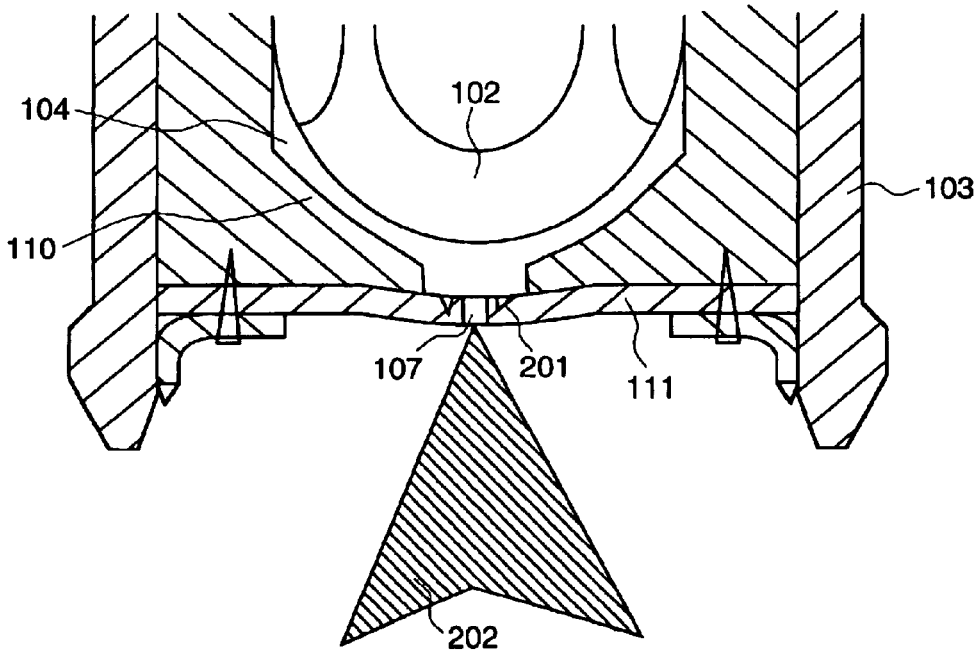
FIG. 13 is a vertical cross sectional view of a nozzle portion in an embodiment of a fuel injection valve with a single injection hole according to the present invention.

In the above described-embodiments, fuel injection valves are employed in which a plurality of injection holes 107 are provided on the plate member 111; however, the present invention is not limited to such embodiments, in that, as shown in FIG. 13, for a fuel injection valve having a single injection hole 107 on the plate member 111, a single groove which runs along the circumferential direction of the injection hole 107 can be provided.

Figure 14:
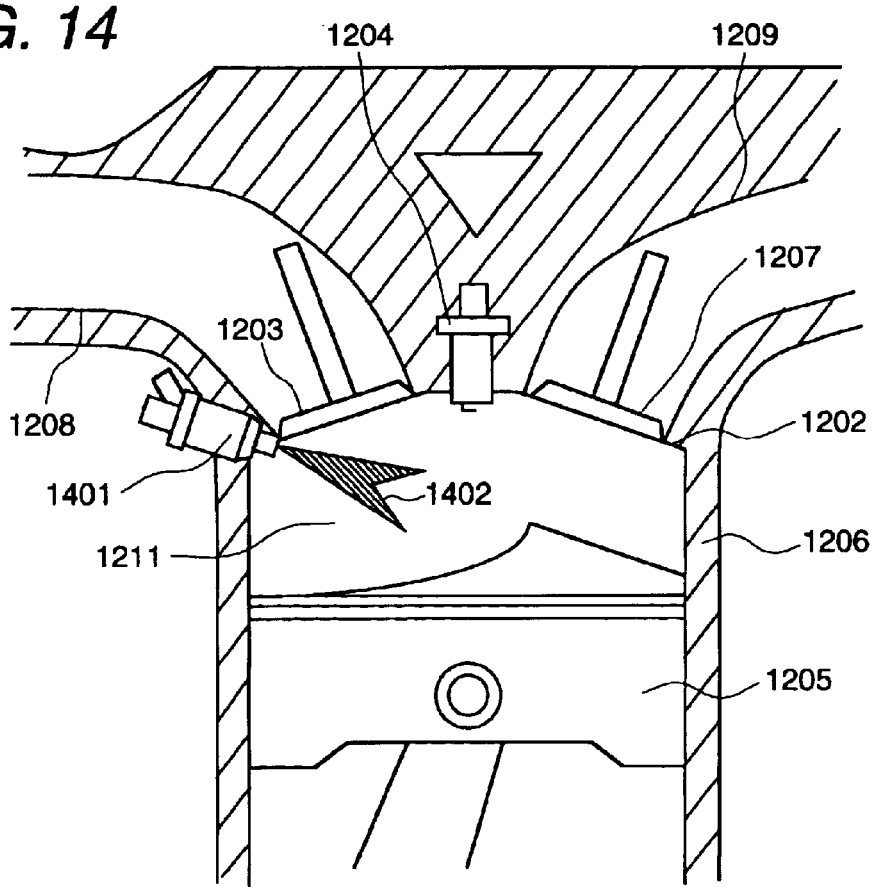
FIG. 14 is a partial cross sectional view of an embodiment in which a direct injection type fuel injection valve according to the present invention is mounted on an internal combustion engine.

FIG. 14 is a partial cross sectional view of a further embodiment, in which a direct injection type fuel injection valve 1401, having a single injection hole 107 in the plate member 111, as shown in FIG. 13 and from which fuel is injected directly into the combustion chamber 1211 is mounted on the internal combustion engine. The direct injection type fuel injection valve 1401 is mounted directly on the cylinder 1206 near the intake valve 1203, and a fuel spray 1402 is directly injected into the combustion chamber 1211.

In the above described embodiments, solenoid type fuel injection valves have been considered, however, the present invention is not limited to the use of such valves, and the present invention can be generally applied to fuel injection valves other than the solenoid type within a range where substantially the same function and advantages as the present embodiments can be obtained.

According to each of the above-described embodiments, a structure for atomizing fuel is provided near the nozzle end of the injection valve, so that an effective fuel atomization can be achieved.

Therefore, in an internal combustion engine according to the present invention, which is provided with the fuel injection valve of the present invention, since the atomization performance of the fuel spray injected from the fuel injection valve is excellent, the exhaust amount of unburned components (HC,CO) can be reduced.

According to the present invention, through the formation of fuel overflows at positions where grooves are located in relation to the fuel injection holes, and, further, through the formation of a contracted flow portion in the fuel injection holes, which provides the advantage of increasing the maximum flow velocity of the spray at the injection hole outlet portion, the turbulence of the gas and the liquid interface between the fuel and the air is accelerated and the atomization performance is improved. Thereby, in an internal combustion engine using the same, since the atomization performance of the fuel spray injected from the fuel injection valve is excellent, the exhaust amount of unburned components (HC,CO) can be reduced.

What is claimed is:

1. A fuel injection valve comprising, a plate member having a plurality of injection holes penetrating the plate member in the thickness direction thereof, a valve seat located at an upstream side of the plate member in the direction of fuel flow, a valve body which is movable to effect opening and closing of a fuel passage in connection with the valve seat, and a driving means for driving the valve body, wherein a flat portion is provided between the respective injection holes on first face of the plate member in the fuel passage facing toward the upstream side of the plate member, and wherein a plurality of grooves are formed in the flat portion along the circumferential direction around the respective injection holes, such that said grooves are recessed in said flat portion relative to openings of the injection holes in said flat portion.

2. A fuel injection valve according to claim 1, wherein the plural number of injection holes in the plate member are separated by the flat portion, and the distance between the groove formed around an injection hole and the injection hole is smaller than the length of the flat portion formed between the injection holes.

3. A fuel injection valve according to claim 1, wherein the plural number of injection holes in the plate member are separated by the flat portion, and the grooves provided in connection with the respective injection holes on the face of the plate member have a circular shape.

4. A fuel injection valve according to claim 1, wherein the plural number of injection holes in the plate member are separated by the flat portion, and the grooves provided in connection with the respective injection holes on the face of the plate member have a shape such that, as seen in vertical cross section, the grooves form a V-shape.

5. A fuel injection valve according to claim 4, wherein an inclination angle of the inner wall near each injection hole of the V-shaped grooves provided in connection with the respective injection holes on the face of the plate member is large in comparison with the inclination angle of the inner wall thereof remote from the injection hole.

6. An internal combustion engine comprising, a cylinder, a piston which reciprocates in the cylinder, an air intake means which introduces air into the cylinder, an exhaust means which exhausts combustion gas from the cylinder, a fuel injection valve which directly injects fuel into the cylinder, a fuel supply means which supplies fuel from a fuel tank to the fuel injection valve, and an ignition device which ignites a mixture gas of the air introduced by the intake means into the cylinder and the fuel injected by the fuel injection valve into the cylinder, wherein the fuel injection valve has a plate member having a plurality of injection holes penetrating the plate member in the thickness direction thereof, a valve seat located at the upstream side of the injection hole in the direction of fuel flow, a valve body which is movable to effect opening and closing of a fuel passage in connection with the valve seat, and a driving means for driving the valve body, wherein a flat portion is provided between the respective injection holes on a first face of the plate member in the fuel passage facing toward the upstream side of the plate member, and wherein a plurality of grooves are formed in the flat portion along the circumferential direction around the respective injection holes, such that said grooves are recessed in said flat portion relative to openings of the injection holes in said flat portion.

7. A fuel injection valve according to claim 1, wherein the groove is formed by a plurality of groove portions arranged discontinuously in the circumferential direction thereof such that one groove portion is disposed so as to face another groove portion while sandwiching each of the injection holes.

8. A fuel injection valve according to claim 1, wherein said grooves are annular.

9. A fuel injection valve according to claim 6, wherein said grooves are annular.

* * * * *